US011265094B2

(12) United States Patent
Lefrançois et al.

(10) Patent No.: US 11,265,094 B2
(45) Date of Patent: Mar. 1, 2022

(54) METHOD FOR DETERMINING STATION NAMES OF A LIST OF RADIO STATIONS

(71) Applicants: CONTINENTAL AUTOMOTIVE FRANCE, Toulouse (FR); CONTINENTAL AUTOMOTIVE GMBH, Hannover (DE)

(72) Inventors: David Lefrançois, Levainville (FR); Aymeric Moureau, Gallardon (FR)

(73) Assignees: CONTINENTAL AUTOMOTIVE FRANCE, Toulouse (FR); CONTINENTAL AUTOMOTIVE GMBH, Hannover (DE)

( * ) Notice: Subject to any disclaimer, the term of this patent is extended or adjusted under 35 U.S.C. 154(b) by 190 days.

(21) Appl. No.: 16/642,260

(22) PCT Filed: Sep. 4, 2018

(86) PCT No.: PCT/FR2018/052153

§ 371 (c)(1),
(2) Date: Feb. 26, 2020

(87) PCT Pub. No.: WO2019/048768

PCT Pub. Date: Mar. 14, 2019

(65) Prior Publication Data

US 2021/0075531 A1 Mar. 11, 2021

(30) Foreign Application Priority Data

Sep. 5, 2017 (FR) ..... 1758178

(51) Int. Cl.
*H04H 60/44* (2008.01)
*H04H 60/43* (2008.01)

(52) U.S. Cl.
CPC ..... *H04H 60/44* (2013.01); *H04H 60/43* (2013.01); *H04H 2201/13* (2013.01)

(58) Field of Classification Search
CPC ..... H04H 60/44; H04H 60/43; H04H 2201/13
See application file for complete search history.

(56) References Cited

U.S. PATENT DOCUMENTS

2016/0156338 A1* 6/2016 Benz ..... H03J 1/045 455/158.4

FOREIGN PATENT DOCUMENTS

CN 203104474 U 7/2013
CN 105656586 A 6/2016
(Continued)

OTHER PUBLICATIONS

International Search Report, PCT/FR2018/052153, dated Nov. 29, 2018.

*Primary Examiner* — Ankur Jain
(74) *Attorney, Agent, or Firm* — Nixon & Vanderhye

(57) ABSTRACT

A method for decoding the name of detected radio stations, the method being implemented by a receiving system including at least one radio receiver, each of the received radio signals including a digital datum corresponding, at least intermittently, to the name of the radio station, the method including the following steps: for each radio station belonging to a list of radio stations preselected from the detected radio stations, a first decoding of the digital datum at a first sampling frequency, in order to determine a probable name; for any detected radio station not belonging to the list of preselected radio stations, a second decoding of the digital datum at a second sampling frequency lower than the first, in order to determine a probable name; and measuring a quality of the radio signal and inhibiting the first and second decodings if the quality of the signal drops below a preset threshold.

20 Claims, 1 Drawing Sheet

(56) References Cited

FOREIGN PATENT DOCUMENTS

| | | | |
|---|---|---|---|
| DE | 10 2012 210313 | | 12/2013 |
| EP | 0 946 009 | | 9/1999 |
| EP | 2 863 562 | | 4/2015 |
| FR | 2 977 417 | | 1/2013 |
| KR | 10-2013-0047980 | A | 5/2013 |
| KR | 20136 0047980 | | 5/2013 |

* cited by examiner

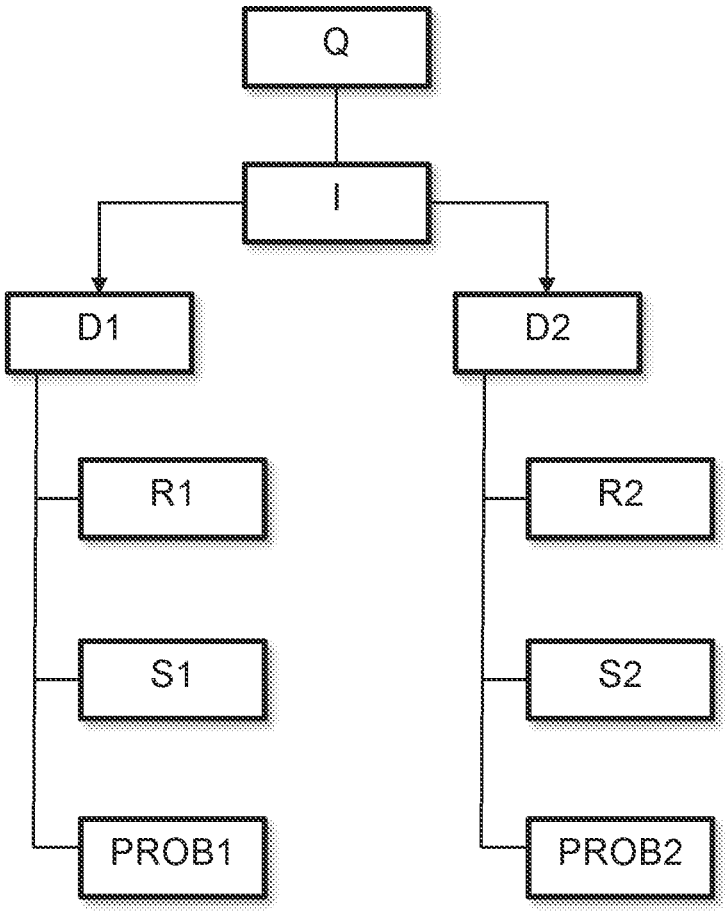
Q
I
D1
D2
R1
R2
S1
S2
PROB1
PROB2

METHOD FOR DETERMINING STATION NAMES OF A LIST OF RADIO STATIONS

BACKGROUND OF THE INVENTION

Field of the Invention

The invention relates to the field of radio receivers in the context of implementation of the RDS standard, RDS standing for Radio Data System.

More precisely, the present invention relates to a method for determining the name of each radio station detected in a frequency band in question, in particular the FM band, with a view to displaying each of said names on a display screen of a radio receiving system.

Description of the Related Art

At the present time, most radio receivers are compatible with the RDS standard. Said radio receivers are generally integrated into receiving systems, or even into multimedia systems, especially ones located on-board vehicles, that are able to display information contained in the radio signal.

In particular, the RDS standard makes provision for a radio signal emitted by a broadcaster to comprise a field, designated PS for Program Service in said standard, for the name of the radio station, so that said name may be displayed by the receiving system and thus the listener may be kept informed of the station that he is listening to.

In many current multimedia systems, especially those located on-board vehicles, a display screen moreover presents a list, especially a drop-down list, comprising a set of names of radio stations that are preselected or simply detected by the radio receiver, so that the user may directly choose the radio station that he desires to listen to.

However, as known, many broadcasters have, over time, misused the PS field, which is intended in the RDS standard to contain the name of the radio station, in order to display information other than said name of the station. For example, the PS field is at the current time used to display, in addition to the name of the station, the name of an artist, of a program, of the music being broadcast, etc.

In general, the PS field contained in the multiplexed radio signal is then updated by the transmitting broadcaster regularly and its content alternates between the name of the station and the other information that said broadcaster desires to have displayed by the multimedia system, "misusing" the PS field such as provided for in the RDS standard.

The PS field is thus a digital datum, encoded in the multiplexed radio signal, that is liable to correspond to the name of the radio station.

One drawback of this state of affairs resides in the difficulty created, for the radio receiver, as regards detection of the correct station name in the received multiplex radio signal.

Specifically, when a multiplexed radio signal is received and decoded, there is no direct means of being certain that the content of the PS field detected first indeed corresponds to the name of the radio station.

Thus, in particular, the list of preselected stations, in particular, may display titles with no relation to the name of certain radio stations because the receiver, at the moment at which the radio signal corresponding to said station was decoded, determined an erroneous station name.

To mitigate this drawback, methods have been developed for determining the name of a radio station in the process of being listened to.

It is in particular known to carry out statistical processing on a set of PS fields successively decoded from a radio signal corresponding to a station in the process of being listened to by the user.

Depending on the number of times an identical title appears and the time for which said title does not change, this known method determines, among the various PS fields decoded, in said time, which one indeed corresponds to the name of the radio station.

Document FR 2 977 417 describes such an example of a method, the objective of which is to determine the name of a radio station by statistically processing a set of decoded PS fields.

However, this solution has the drawback of monopolizing a radio receiver continuously for several minutes, in order to allow the complete implementation of the method, with a view to determining, almost with certainty, the name of a set of radio stations. It could be envisioned to employ this solution to decode all of the radio-station names of a list of preselected stations, or even all of the names of radio stations detectable in the frequency band captured by a radio receiver in question, but this would require a radio receiver to be dedicated to this task of decoding the radio-station names. Multi-tuner multimedia systems, or in other words multi-receiver radios, certainly do exist but having to dedicate a radio receiver 100% to simply decoding the successive PS fields contained in the received radio signals is not economically satisfactory.

In a radio receiving system there is therefore a need for a method allowing the names of radio stations to be detected, in particular when said radio stations belong to a list of preselected stations, which are generally permanently accessible to the user, in order to ensure that the radio-station names displayed by said receiving system are correct.

SUMMARY OF THE INVENTION

To this end, one subject of the invention is a method for decoding the name of detected radio stations, said method being intended to be implemented by a receiving system comprising at least one radio receiver, said detected radio stations each corresponding to a multiplexed radio signal received by said at least one radio receiver, each of said received multiplexed radio signals comprising a digital datum corresponding, at least intermittently, to the name of the radio station, said method comprising the following steps:

for each radio station belonging to a list of radio stations preselected from said detected radio stations, a first decoding of the digital datum at a first sampling frequency, comprising, at any given time, depending on the first sampling frequency, reading said digital datum to determine a possible name of the radio station, storing the successive possible names read and statistically processing the successive possible names read to determine a probable name of the radio station, for any detected radio station not belonging to the list of the preselected radio stations, a second decoding of the digital datum at a second sampling frequency lower than the first sampling frequency, comprising, at any given time, depending on the second sampling frequency, reading the digital datum to determine a possible name of the radio station, storing the successive possible names read, and comparing said possible name of the radio station determined at the time in question to the possible name determined at the preceding time in order to determine, if two successively determined possible names are identical, a probable name of the radio station, measuring a quality of the radio signal and inhibiting the first and second decodings if the quality of the signal drops below a preset threshold.

By virtue of the method according to the invention, the radio stations detected by the receiving system, and as a priority those belonging to the list of preselected stations, have an improved probability of seeing their actual name displayed by said receiving system, without adversely affecting the quality of reception of the radio signals.

According to one embodiment, the radio signal is encoded according to the radio data system of the RDS standard and the digital datum corresponds to the field designated PS in said radio data system of the RDS standard.

According to one embodiment, the comparing step of the second decoding comprises comparing said possible name of the radio station determined at the time in question to at least two successive possible names determined at successive preceding times, in order to determine, if the at least three successively determined possible names are identical, a probable name of the radio station.

According to one embodiment, the first sampling frequency is comprised between a first decoding every eight seconds and a first decoding every sixteen seconds.

According to one embodiment, the second sampling frequency is comprised between a second decoding every four minutes and a second decoding every six minutes.

According to one embodiment, the receiving system also performs an informing function, corresponding to the reception of an information signal and to the transmission of information, contained in said information signal, to the driver of the vehicle, said method comprising inhibiting the first and second decoding on reception of an information signal, until the end of the transmission of said information.

For example, it may be a question of information relating to traffic, to the weather, etc.

According to one embodiment, if the receiving system comprises a single radio receiver, said radio receiver either receives and decodes the radio signal corresponding to the selected radio station, with a view to said signal being played, or implements the first decoding and the second decoding, except in case of inhibition of said first and second decodings.

According to one embodiment, if the receiving system comprises two radio receivers, a first radio receiver receives and decodes the radio signal corresponding to the selected radio station, with a view to said signal being played, and a second radio receiver implements the first decoding and the second decoding, except in case of inhibition of said first and second decodings.

The present invention also relates to a vehicle radio receiving system, comprising a computer configured to control at least one radio receiver, in order to implement the method briefly described above.

The present invention also relates to a motor vehicle comprising such a radio receiving system.

BRIEF DESCRIPTION OF THE DRAWINGS

Other features and advantages of the invention will become apparent from the following description, which is given with reference to the appended figure.

The figure shows the block diagram showing the steps of the method according to the invention.

DESCRIPTION OF THE PREFERRED EMBODIMENTS

The invention is envisioned mainly with a view to an implementation in a vehicle, especially a motor vehicle. However, the implementation of the invention in other contexts, in particular in any radio receiving system or in any multimedia system intended to display the names of a list of detected radio stations, is also targeted.

To improve the determination of names of radio stations detected by a receiving system, the present invention proposes a method comprising two distinct decoding levels.

It will be recalled that the context is that of a radio receiving system comprising at least one radio receiver and a screen able to display the name of the radio stations detected by said at least one radio receiver.

A function performed by most receiving systems allows the user to preselect a certain number of radio stations to form a list of preselected stations corresponding to radio stations that the user desires to be able to rapidly find with a view to listening to them, on the face of it regularly. In general, the list of preselected stations is permanently accessible to the user and the names of the stations must therefore as a priority be reliably determined.

Thus, with reference to the figure, for any radio station belonging to such a list of preselected stations, in practice corresponding to a list of stations permanently displayed or at least frequently displayed on the screen of the receiving system, a first decoding D1, at a high sampling frequency, is implemented. The objective of the first decoding D1 is to allow rapid decoding of the names of the stations belonging to the list of preselected stations, said names of said radio stations belonging to the list of preselected stations to be frequently displayed on the screen of the receiving system.

Again with reference to the figure, for any detected radio station not belonging to said list of preselected stations, the method according to the invention makes provision to implement a second decoding D2, at a low sampling frequency.

The objective of the second decoding D2 is to consolidate the probable names of all of the detected radio stations not belonging to the list of preselected stations.

Moreover, with reference to the figure, provision is made, according to the invention to inhibit I the first decoding D1 and the second decoding D2 when the measured quality Q of the signal is insufficient, both because, in this case, the decoding of the PS field takes more time and in order to not monopolize for too much time the radio receiver, as this would risk degrading listening quality.

In practice, the present invention is mainly intended to be implemented in a radio receiving system having one or two radio receivers. The method, except in case of inhibition because the received signal is of insufficient quality, then implements the first and second decodings in parallel. The first decoding D1 rapidly decodes the probable name of the radio stations belonging to the list of preselected stations. The second decoding D2 then decodes the probable name of the radio stations not belonging to the list of preselected stations more slowly in the "background". Assuming that the radio receiving system has only one radio receiver, then the method according to the invention is implemented only if the radio receiver is not an active source playing a signal that is being listened to by the user. Assuming that the radio receiving system has two radio receivers, one receiver may be dedicated to the reception and decoding of the received radio signal corresponding to the radio station being listened to by the user, whereas the second radio receiver implements the method according to the invention.

In both cases, i.e. when the radio receiving system has a single or two radio receivers, the quality of the signal is measured Q continuously, the first and second decodings D1, D2 being inhibited if said measured quality Q of the signal is insufficient. In practice, the measurement Q of the quality of the signal may correspond to a measurement of the power of the received radio signal, to a measurement of the signal-to-noise ratio of the received radio signal, or even to a measurement of RSSI, for Received Signal Strength Indication. The quality of the signal thus measured Q is then compared to a chosen threshold, which is for example chosen empirically by the manufacturer, in order to determine whether the quality is sufficient or not. If the quality is sufficient, the first decoding D1 and the second decoding D2 are implemented. If the quality is insufficient, the first and second decodings D1, D2 are inhibited.

The first and second decodings D1, D2 are thus inhibited I when the quality of the signal is insufficient. In particular, when the radio receiving system comprises two radio receivers and is able to recombine the signals received by the respective antennas of said two radio receivers, for example using a so-called "phase-diversity" method, then said two radio receivers are monopolized, as a priority, to improve the quality of the received radio signal, and the first and second decodings D1, D2 are therefore inhibited. In other words, the determination of the names of the radio stations is a low-priority process; when high-priority processing is required, such as the search for an alternative that would allow the radio station being listened to continue to be received, the method makes provision to inhibit I the first and second decodings D1, D2.

Furthermore, when a receiving system located on-board a motor vehicle also performs an informing function (such as one providing information relating to traffic or to the weather for example) corresponding to the reception of an information signal and to the transmission of said information to the driver of the vehicle, said method also makes provision to inhibit the first and second decodings D1, D2 on reception of an information signal, until the end of the transmission of said information.

Moreover, the role of the first decoding D1, as indicated above, is to rapidly decode the probable name of the radio stations belonging to the list of preselected stations. Thus, the first sampling frequency, corresponding to the frequency at which the first decoding D1 decodes the PS field in each received radio signal corresponding to a radio station belonging to the list of preselected stations, is high. According to one embodiment, said first sampling frequency is comprised between 8 and 16 seconds, and for example equal to 12 seconds, allowing the fact that the PS field encoded in the multiplexed radio signal, according to the RDS standard, is potentially updated about every 5 seconds, to be taken into account.

In parallel, the role of the second decoding D2 is to perform background decoding in order to determine the probable name of detected radio stations not belonging to the list of preselected radio stations. Thus, the second sampling frequency, corresponding to the frequency at which the second decoding D2 decodes the PS field in each detected radio signal corresponding to a radio station not belonging to the list of preselected stations, is low. According to one embodiment, said first sampling frequency is comprised between 4 and 6 minutes, and for example equal to 5 minutes, allowing the fact that a program, and in particular a song broadcast by a station, has an average length of 3-4 minutes, to be taken into account, so that, if the broadcaster of the radio station in question uses the PS field to broadcast the name of the song in the process of being listened to, said PS field will have changed between two successive iterations of the second decoding D2.

With respect to the first decoding D1, with reference to the figure, provision is made, at any given time, depending on the first sampling frequency:

- to read R1 the PS field contained in the received multiplexed radio signal, in order to determine a possible name of the radio station,
- to store S1 the successive possible names read, and
- to statistically process PROB1 the successive possible names read in order to determine a probable name of the radio station.

Such statistical processing may be carried out in various ways, at the choice of those skilled in the art. In particular, depending on the number of times an identical PS-field title appears and on the time for which said PS-field title does not change, a confidence index is attributed to said probable name. The more often and the longer the time for which said probable name appears, for example, the higher the confidence index and the more chance the probable name has of being the actual name of the station.

According to one embodiment, above a preset threshold, the confidence index is sufficiently high to allow the probable name to be considered to certainly be the name of the radio station in question and the implementation of the first decoding D1 may be inhibited for said radio station.

The second decoding D2 is implemented for any detected radio station not belonging to the list of preselected radio stations. Said second decoding D2 comprises, at any given time, depending on the second sampling frequency:

- reading R2 the PS field contained in the received multiplexed radio signal, in order to determine a possible name of the radio station,
- storing S2 the successive possible names read, and
- comparing PROB2 said possible name of the radio station determined at the time in question to the possible name determined at the preceding time in order to determine, if two successively determine possible names are identical, a probable name of the radio station.

According to one embodiment, the possible name determined at a given time is compared to at least two successive possible names determined at two preceding successive times, in order to determine, if the at least three possible names are identical, the probable name of the radio station.

Depending on the number of times a given PS field appears in the list of possible names, in the context of the implementation of the second decoding D2, a confidence index may also be attributed to the probable name, said confidence index increasing, for example, with the number of occurrences of said probable name. According to one embodiment, if a preset threshold is exceeded, the probable name may be considered to certainly be the name and the implementation of the second decoding D2 may be inhibited for said radio station.

It is furthermore specified that the present invention is not limited to the examples described above, and is open to variants that will appear obvious to those skilled in the art.

The invention claimed is:

1. A method for decoding the name of detected radio stations, said method being intended to be implemented by a receiving system comprising at least one radio receiver, said detected radio stations each corresponding to a multiplexed radio signal received by said at least one radio receiver, each of said received multiplexed radio signals comprising a digital datum corresponding, at least intermittently, to the name of the radio station, said method comprising the following steps:

for each radio station belonging to a list of radio stations preselected from said detected radio stations, a first decoding (D1) of the digital datum at a first sampling frequency, comprising, at any given time, depending on the first sampling frequency, reading (R1) said digital datum to determine a possible name of the radio station, storing (S1) the successive possible names read and statistically processing the successive possible names read to determine (PROB1) a probable name of the radio station, for any detected radio station not belonging to the list of preselected radio stations, a second decoding (D2) of the digital datum at a second sampling frequency lower than the first sampling frequency, comprising, at any given time, depending on the second sampling frequency, reading (R2) the digital datum to determine a possible name of the radio station, storing (S2) the successive possible names read, and comparing said possible name of the radio station determined at the time in question to the possible name determined at the preceding time in order to determine (PROB2), if two successively determined possible names are identical, a probable name of the radio station, measuring (Q) a quality of the radio signal and inhibiting (I) the first and second decodings if the quality of the signal drops below a preset threshold.

2. The method as claimed in claim 1, wherein the radio signal is encoded according to the radio data system of the RDS standard and the digital datum corresponds to the field designated PS in said radio data system of the RDS standard.

3. The method as claimed in claim 2, wherein the comparing step of the second decoding comprises comparing said possible name of the radio station determined at the time in question to at least two successive possible names determined at successive preceding times, in order to determine (PROB2), if the at least three successively determined possible names are identical, a probable name of the radio station.

4. The method as claimed in claim 2, wherein the first sampling frequency is comprised between a first decoding (D1) every eight seconds and a first decoding (D1) every sixteen seconds.

5. The method as claimed in claim 2, wherein the second sampling frequency is comprised between a second decoding (D2) every four minutes and a second decoding (D2) every six minutes.

6. The method as claimed in claim 2, wherein the receiving system, which is located on-board a vehicle, also performs an informing function, corresponding to the reception of an information signal and to the transmission of information, contained in said information signal, to the driver of the vehicle, said method comprising inhibiting the first and second decodings (D1, D2) on reception of an information signal, until the end of the transmission of said information.

7. The method as claimed in claim 1, wherein the comparing step of the second decoding comprises comparing said possible name of the radio station determined at the time in question to at least two successive possible names determined at successive preceding times, in order to determine (PROB2), if the at least three successively determined possible names are identical, a probable name of the radio station.

8. The method as claimed in claim 7, wherein the first sampling frequency is comprised between a first decoding (D1) every eight seconds and a first decoding (D1) every sixteen seconds.

9. The method as claimed in claim 7, wherein the second sampling frequency is comprised between a second decoding (D2) every four minutes and a second decoding (D2) every six minutes.

10. The method as claimed in claim 7, wherein the receiving system, which is located on-board a vehicle, also performs an informing function, corresponding to the reception of an information signal and to the transmission of information, contained in said information signal, to the driver of the vehicle, said method comprising inhibiting the first and second decodings (D1, D2) on reception of an information signal, until the end of the transmission of said information.

11. The method as claimed in claim 1, wherein the first sampling frequency is comprised between a first decoding (D1) every eight seconds and a first decoding (D1) every sixteen seconds.

12. The method as claimed in claim 11, wherein the second sampling frequency is comprised between a second decoding (D2) every four minutes and a second decoding (D2) every six minutes.

13. The method as claimed in claim 11, wherein the receiving system, which is located on-board a vehicle, also performs an informing function, corresponding to the reception of an information signal and to the transmission of information, contained in said information signal, to the driver of the vehicle, said method comprising inhibiting the first and second decodings (D1, D2) on reception of an information signal, until the end of the transmission of said information.

14. The method as claimed in claim 1, wherein the second sampling frequency is comprised between a second decoding (D2) every four minutes and a second decoding (D2) every six minutes.

15. The method as claimed in claim 14, wherein the receiving system, which is located on-board a vehicle, also performs an informing function, corresponding to the reception of an information signal and to the transmission of information, contained in said information signal, to the driver of the vehicle, said method comprising inhibiting the first and second decodings (D1, D2) on reception of an information signal, until the end of the transmission of said information.

16. The method as claimed in claim 1, wherein the receiving system, which is located on-board a vehicle, also performs an informing function, corresponding to the reception of an information signal and to the transmission of information, contained in said information signal, to the driver of the vehicle, said method comprising inhibiting the first and second decodings (D1, D2) on reception of an information signal, until the end of the transmission of said information.

17. The method as claimed in claim 1, wherein, if the receiving system comprises a single radio receiver, said radio receiver receives and decodes the radio signal corresponding to the selected radio station, with a view to said signal being played, or implements the first decoding (D1) and the second decoding (D2), except in case of inhibition (I) of said first and second decodings (D1, D2).

18. The method as claimed in claim 1, wherein, if the receiving system comprises two radio receivers, a first radio receiver receives and decodes the radio signal corresponding to the selected radio station, with a view to said signal being played, and a second radio receiver implements the first decoding (D1) and the second decoding (D2), except in case of inhibition (I) of said first and second decodings (D1, D2).

19. A motor-vehicle radio receiving system, comprising a computer configured to control at least one radio receiver, in order to implement the method as claimed in claim 1.

20. A vehicle comprising a radio receiving system according to claim 19.

* * * * *